US005618107A

United States Patent [19]

Bartsch

[11] Patent Number: 5,618,107

[45] Date of Patent: Apr. 8, 1997

[54] BEARING ASSEMBLY FOR AGITATOR SHAFT

[75] Inventor: Steve A. Bartsch, Marshfield, Wis.

[73] Assignee: A&B Process Systems Corporation, Stratford, Wis.

[21] Appl. No.: 659,869

[22] Filed: Jun. 7, 1996

[51] Int. Cl.[6] ..... B01F 7/16

[52] U.S. Cl. ..... 366/279; 366/331; 366/249; 384/276; 384/428; 384/901

[58] Field of Search ..... 366/279, 285, 366/286, 314, 330.1, 330.4, 330.5, 241, 242, 244, 245, 247, 248, 249, 250, 251, 331; 384/276, 428, 901

[56] References Cited

U.S. PATENT DOCUMENTS

| | | | |
|---|---|---|---|
| 2,215,808 | 9/1940 | Ebert | 366/279 |
| 3,149,888 | 9/1964 | Lennon | 366/331 |
| 3,443,794 | 5/1969 | Peterson . | |
| 3,489,469 | 1/1970 | Stratienko | 308/36.3 |
| 4,620,805 | 11/1986 | Belanger | 384/428 |
| 4,660,989 | 4/1987 | Davis | 366/331 |
| 5,102,239 | 4/1992 | Momose et al. | 384/901 |
| 5,549,386 | 8/1996 | Pardo | 366/331 |

*Primary Examiner*—Robert W. Jenkins
*Attorney, Agent, or Firm*—Michael, Best & Friedrich

[57] ABSTRACT

The bearing assembly for supporting one end of a rotatable shaft, such as the lower end of an agitator drive shaft inside a mixing tank, includes a mounting sleeve surrounded and spaced radially outwardly from the lower end of the drive shaft, a support supporting the mounting sleeve at a location where there is sufficient space between the mounting sleeve and the tank bottom to gain access to the lower end of the drive shaft, an annular bearing slidably mounted on the drive shaft, a bearing housing disposed inside the mounting sleeve and receiving the bearing to provide a bearing/bearing housing subassembly and a locking arrangement on the bearing housing and the mounting sleeve. The locking arrangement permits movement of the bearing/bearing housing subassembly between a locked position where it can be moved longitudinally relative to the drive shaft into and out of the mounting sleeve and a locked position inside the mounting sleeve where the bearing housing is restrained against longitudinal movement relative to the drive shaft. When in the unlocked position, the bearing/bearing housing assembly can be withdrawn from the mounting sleeve and completely off the end of the drive shaft and moved away from the shaft through the space between the mounting sleeve and the tank bottom wall.

14 Claims, 2 Drawing Sheets

BEARING ASSEMBLY FOR AGITATOR SHAFT

BACKGROUND OF THE INVENTION

This invention relates to bearing assemblies and, more particularly, to bearing assemblies for supporting one end of a rotatable shaft against radial loads, such as the lower end of a drive shaft of an agitator extending into a mixing tank.

Chemical and food processing operations often employ mixing tanks including a vertical shaft which projects down into the tank and carries one or more impellers or agitator blades for mixing or agitating materials in the tank. The lower end of the drive shaft inside the tank typically is supported against radial loads by a bearing assembly mounted on the bottom of the tank.

When a corrosive and/or abrasive material is to be mixed, the bearing assembly usually is enclosed in the housing to isolate it from the material. Examples of such constructions are described in U.S. Peterson patent U.S. Pat. No. 3,443,794, U.S. Stratienko patent U.S. Pat. No. 3,489,469 and U.S. Davis patent U.S. Pat. No. 4,660,989.

In applications where the materials to be mixed are neither corrosive nor abrasive, the bearing assembly does not necessarily have to be isolated and a less complicated mounting arrangement can be used. For such applications, particularly food processing where certain sanitary conditions must be maintained, it is highly desirable for the bearing assembly to be designed to facilitate convenient cleaning while in place, that is, without any disassembly.

The bearing serves as a wear device and typically is made from a low friction synthetic plastic material which is inert to the material being mixed. The bearing tends to wear with use and must be replaced periodically. Some conventional bearing assemblies require considerable disassembly of the drive shaft to replace the bearing. Other conventional bearing assemblies permit a bearing to be replaced without disassembly of the agitator drive shaft; however, it is difficult to properly clean the bearing surfaces and other surfaces of the assembly exposed to the material being mixed while the bearing assembly is in place.

SUMMARY OF THE INVENTION

A primary object of the invention is to provide a simple, relatively inexpensive bearing assembly for supporting one end of a rotatable shaft, such as the lower end of an agitator drive shaft inside a mixing tank, which is arranged to permit the bearing to be conveniently replaced without disassembling the shaft.

Another principal object of the invention is to provide such a bearing assembly for the lower end of an agitator drive shaft in a mixing tank.

A further principal object of the invention is to provide a bearing assembly described in the immediately preceding paragraph which can be exposed to materials being mixed and all exposed surfaces can be conveniently cleaned while the bearing assembly is in place.

Other objects, aspects and advantages of the invention will become apparent to those skilled in the art upon reviewing the following detailed description, the drawings and the appended claims.

The invention provides a bearing assembly for supporting one end of a rotatable shaft, such as the lower end of an agitator drive shaft in a mixing tank, including a mounting sleeve surrounding and spaced radially outwardly from the shaft, support means supporting the mounting sleeve at a location where it is spaced far enough away from a support surface to afford access to the shaft through the space between the mounting sleeve and the support surface, an annular bearing slidably mounted on the shaft, a bearing housing disposed inside the mounting sleeve and including a bore receiving the bearing to provide a bearing/bearing housing subassembly and locking means on the bearing housing and the mounting sleeve which cooperate to afford longitudinal movement of the subassembly relative to the shaft and to the mounting sleeve between unlocked and locked positions. When in the unlocked position, the subassembly can be moved longitudinally relative to the shaft into and out of the mounting sleeve and, when in the locked position, the subassembly is located inside the mounting sleeve and the bearing housing is restrained against longitudinal movement relative to the shaft. The end of the shaft is spaced far enough away from the support surface so that, when in the unlocked position, the subassembly can be withdrawn from the mounting sleeve and completely off the end of the shaft and moved away from the shaft through the space between the mounting sleeve and the support surface for replacement of the bearing. In one embodiment, the mounting sleeve includes limit means for limiting longitudinal movement of the bearing relative to the bearing housing in a direction away from the support surface, thereby preventing the bearing from riding up the shaft and out of contact with the bearing housing during operation.

In another embodiment, the locking means includes a plurality of circumferentially spaced pins extending radially outwardly from the outer periphery of the bearing housing and a plurality of circumferentially spaced, inverted generally J-shaped slots in the mounting sleeve for receiving the pins.

In another embodiment, the bearing includes a plurality of circumferentially spaced axially extending grooves in the inner and outer peripheries thereof for affording a flow of liquid between the bearing and the shaft and between the bearing and the bearing housing, thereby facilitating cleaning of the bearing assembly in place.

DESCRIPTION OF THE PREFERRED EMBODIMENTS

While the invention can be used for a variety of applications where it is desirable to support one end of a rotatable shaft against radial loads and have the capability of conveniently replacing worn out bearings, it is particularly adaptable for supporting the lower end of an agitator drive shaft located inside a mixing tank and will be described in connection with that application.

Figure 1:
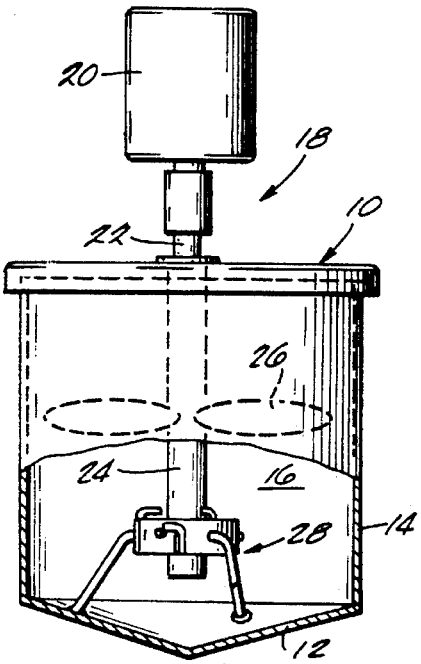
FIG. 1 is a partially broken away side view of a conventional mixing tank and agitator employing a bearing assembly of the invention.

Illustrated in FIG. 1 is a conventional mixing tank 10 having a bottom wall 12 and a side wall 14 defining a chamber 16 for containing a liquid to be mixed. The mixing tank 10 includes a conventional agitator 18 for mixing the liquid and having a suitable drive unit 20, such as a suitable electric motor, mounted outside the chamber 16 and operably connected to a vertical drive shaft 22 having a lower end 24 extending into the chamber 16. The drive shaft 22 carries one or more mixing impellers or blades 26.

Figure 5:
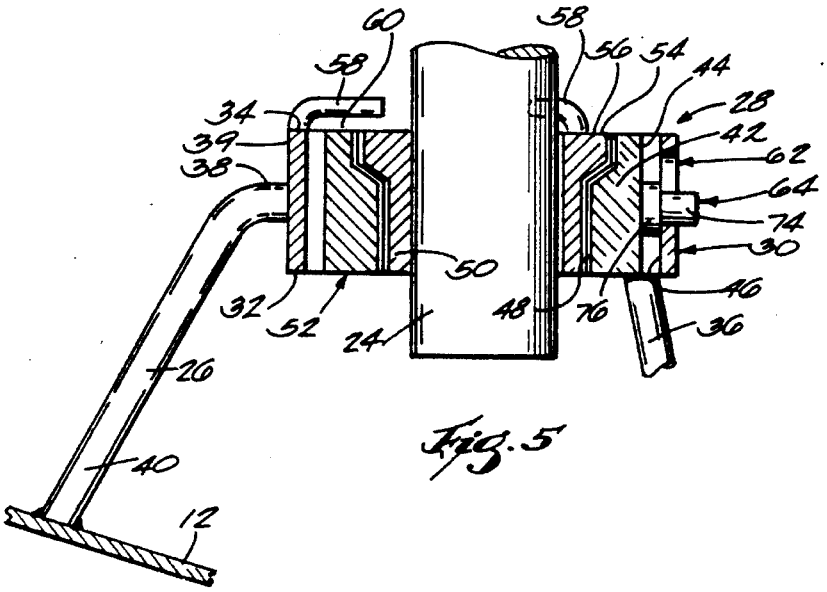
FIG. 5 is a sectional view taken generally along line 5—5 in FIG. 2.
Figure 2:
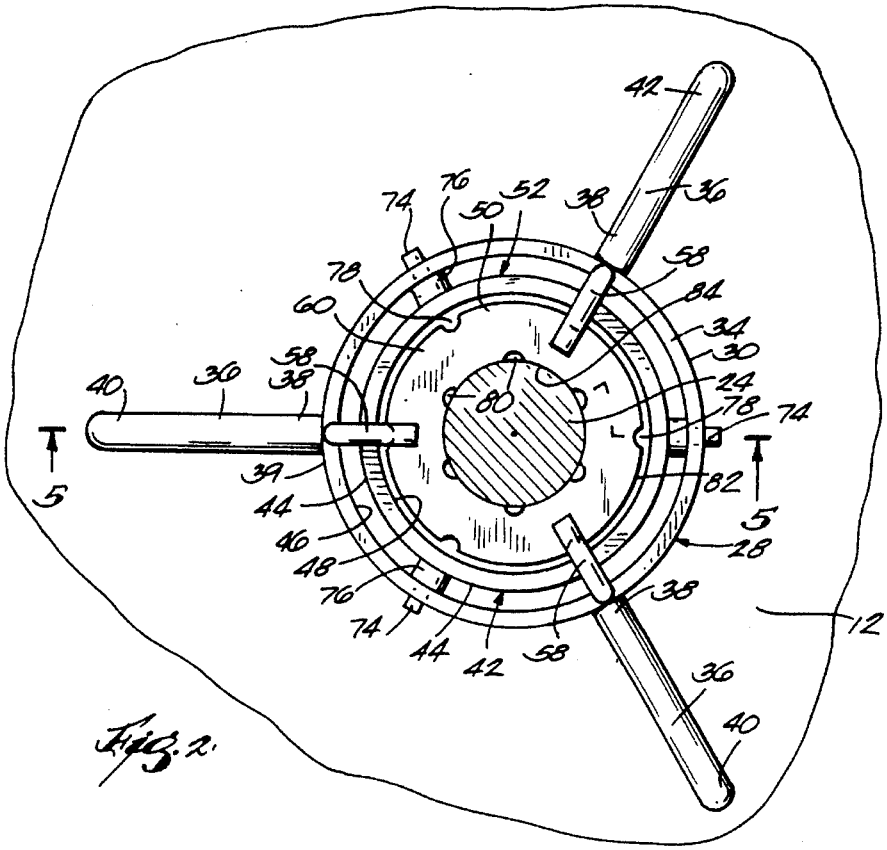
FIG. 2 is an enlarged top view of the bearing assembly illustrated in FIG. 1.
Figure 3:
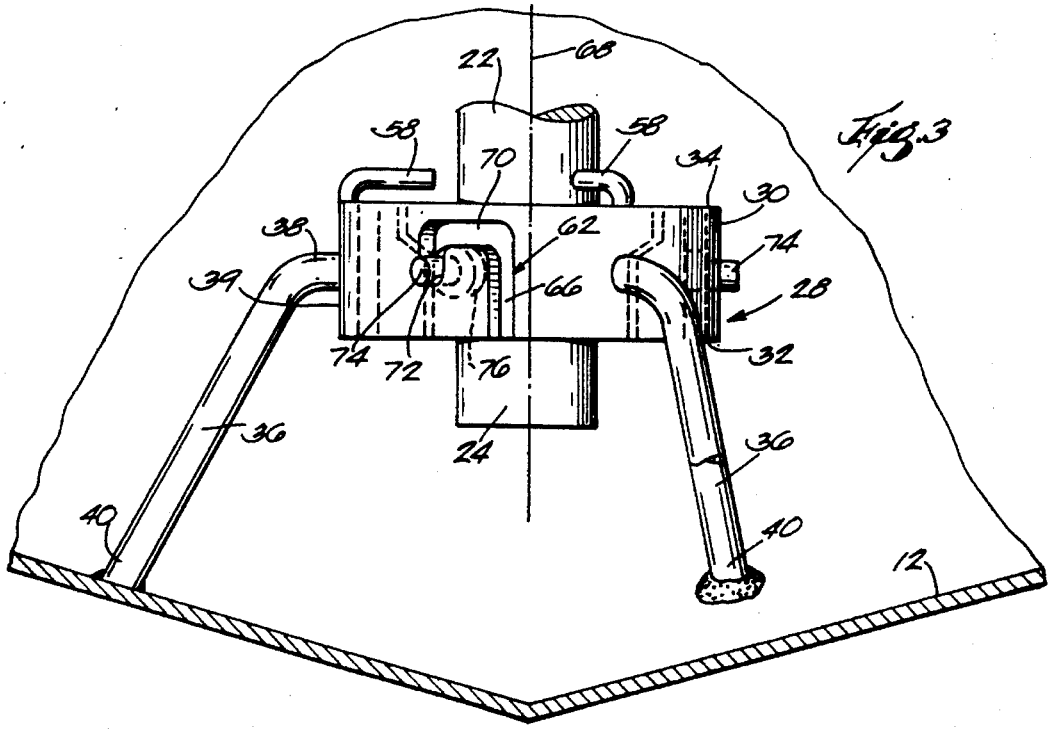
FIG. 3 is a side view of the bearing assembly illustrated in FIG. 2.

The lower end 24 of the drive shaft 22 is supported against radial loads by a bearing assembly 28 of the invention mounted on the bottom wall 12 of the tank 10. The bearing assembly 28 (FIGS. 2, 3 and 5) includes a mounting sleeve 30 which surrounds and is spaced radially outwardly from the lower end 24 of the drive shaft 22. The mounting sleeve 30 has a bottom edge 32 facing the bottom wall 12 of the tank 10 and an opposed top edge 34. The mounting sleeve 30 is supported on the bottom wall 12 of the tank 10 by a plurality (e.g., 3) circumferentially spaced legs 36 having one end 38 suitably affixed to the outer surface 39 of the mounting sleeve 30 and the opposite end 40 suitably affixed to the bottom wall 12 of the tank 10. The legs 36 are dimensioned so that there is enough space between the bottom edge 32 of the mounting sleeve 30 and the bottom wall 12 of the tank 10 for convenient access to the lower end 24 of the drive shaft 22.

A bearing housing 42 (FIGS. 2 and 4) having an outer periphery 44 smaller than the inner periphery 46 of the mounting sleeve 30 is disposed inside and removably mounted on the mounting sleeve 30. The bearing housing 42 has a bore 48 which receives an annular, sleeve-like bearing 50 which is slidably mounted on the lower end 24 of the drive shaft 22. The bearing 50 and the bearing housing 42 form a subassembly 52 which can be removed from the drive shaft 22 without any disassembly of the drive shaft 22 for replacement of a worn out bearing.

Figure 4:
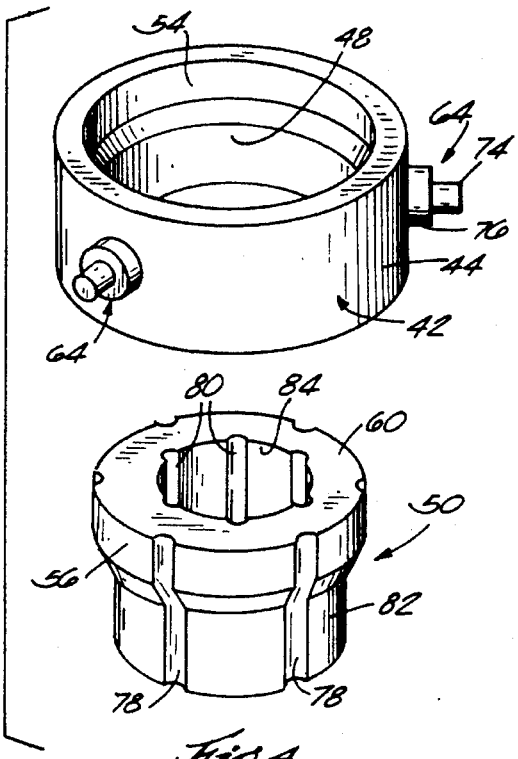
FIG. 4 is an enlarged, exploded view of the bearing and bearing housing.

In the specific construction illustrated, the bearing housing bore 48 has an enlarged upper portion 54 and the upper portion 56 of the bearing 50 has the same shape. The outside diameter of the bearing 50 approximates but is slightly less than the inside diameter of the bushing housing bore 48 and the inside diameter of the bearing 50 approximates but is slightly larger than the outside diameter of the drive shaft 22. Depending on manufacturing tolerances, the drive shaft 22 may rotate relative to the bearing 50 or the bearing 50 rotate with the drive shaft 22 and relative to the bearing housing 42. In FIG. 4, the bearing 50 is shown below the bearing housing 42. In actual practice the bearing 50 is installed in and removed from the top end of the bearing housing 42 as viewed in FIG. 4.

In some circumstances, the bearing 50 can ride up the drive shaft 22, i.e., move upwardly relative to the bearing housing 42, during rotation of the drive shaft 22. Limit means preferably are provided to prevent the bearing 50 from losing contact with the bearing housing 42. In the specific construction illustrated (FIGS. 2, 3 and 5), a plurality (e.g., 3) of circumferentially spaced arms 58 mounted on the mounting sleeve 30 are provided for this purpose. The arms 58 extend horizontally and radially inwardly toward the drive shaft 22 to a point where they are engaged by the upper end 60 of the bearing 50 in the event it moves upwardly relative to the bearing housing 42.

The bearing 50 is made from a low friction material which is inert with respect to the materials to be mixed in the mixing tank. It preferably is formed from a synthetic organic thermoplastic or thermosetting material, such as Teflon and an ultra high molecular weight polyethylene.

The mounting sleeve 30 and the bearing housing 42 preferably are arranged so that the bushing/bearing housing subassembly 52 is removably mounted on the mounting sleeve 30 and can be locked in a position where longitudinal movement of the subassembly 52 relative to the mounting sleeve 30 is restrained. In the specific construction illustrated (FIGS. 3 and 5), this is accomplished by providing a plurality (e.g., 3) of circumferentially spaced, inverted generally J-shaped slots 62 in the mounting sleeve 30 and a like number of circumferentially spaced pins 64 on the bearing housing 42 extending radially outwardly from the outer periphery 44 thereof. Each slot 62 has a generally vertical first portion 66 extending from the bottom edge 32 of the mounting sleeve 30 generally parallel to the rotational axis 68 of the drive shaft 22, a generally horizontal second portion 70 connected to the first portion 66 and extending generally perpendicularly to the first portion 66 and a generally vertical third portion 72 connected to the second portion 70 and extending generally perpendicularly to the second portion 70 in a direction toward the bottom edge 32 of the mounting sleeve 30.

Each pin 64 (FIGS. 3 and 4) has a reduced outer end portion 74 having an outside diameter less than the width of the slots 62 and a larger inner end portion 76 having an outside diameter somewhat larger than the width of the slots 62. The outer end portions 74 are guided by the slots 62 and the inner end portions 76 engage the inner periphery 46 of the mounting sleeve 30 and thereby limit radial movement of the bearing/bearing housing assembly 52 relative to the mounting sleeve 30.

The bearing/bearing housing subassembly 52 is installed by moving it beneath the mounting sleeve 30 and the lower end 24 of the drive shaft 22, slipping the bearing 50 over the drive shaft 22, moving the subassembly upwardly with the pins 64 aligned with the first portions 66 of the slots 62 until the pins 64 bottom at the junctures of the first 66 and second 70 portions. The bearing/bearing housing subassembly 52 is then rotated clockwise as viewed in FIG. 3 until the pins 64 bottom at the junctures of the second 70 and the third portions 72 of the slots 62 and then moved downwardly until the pins 64 bottom out in the third portions 72 of the slots 62.

For applications where the mixing tank 10 must be maintained under sanitary conditions, the mounting sleeve 30, support legs 36, arms 58, bearing housing 42 and pins 64 preferably are constructed from stainless steel or another metal with an appropriate coating and the bearing 50 is made from a suitable synthetic plastic material. To facilitate convenient cleaning of the bearing assembly 28 and the lower end 24 of the drive shaft 22 while in place, a plurality (e.g., 6) of circumferentially spaced, axially extending grooves 78 and 80 (FIGS. 2 and 4) are provided, in the outer periphery 82 and the inner periphery 84 of the bearing 50, respectively. With such an arrangement, a cleaning fluid can easily flow between the drive shaft 22 and the bearing 50 and between the bearing 50 and the bearing housing 42 during rotation of the drive shaft 22, thereby insuring proper cleaning.

For initial installation of a bearing assembly 28 in a mixing tank 10, a full bearing assembly is installed on the lower end 24 of the drive shaft 22 by slipping the bearing 50 thereover and the legs 36 are allowed to rest on the bottom wall 12 of the tank 10. After the agitator drive unit 20 and drive shaft 22 have been aligned to a true vertical, the legs 36 are suitably affixed to the bottom wall 12 of the tank 14, such as by welding.

The legs 36 are spaced far enough apart so that, when a worn out bearing must be replaced, a workman can conveniently reach between two legs and grab the bearing/bearing housing subassembly 52. He or she can remove the subassembly from the mounting sleeve 30 and the drive shaft 22 by pushing it upwardly and then rotating counterclockwise as viewed in FIG. 3 until the pins 64 are aligned with the vertical portions 66 of the slots 62 and moving it downwardly until the bearing 50 is slipped completely off the drive shaft 22. The bearing/bearing housing subassembly 52 can then be withdrawn through the space between the bottom edge 32 of the mounting sleeve 30 and the bottom wall 12 of the tank 10 and between adjacent legs 36 and taken to a location where the bearing 50 can be removed from the bearing housing 42 and replaced with a new one. The bearing/bearing housing subassembly 52 is installed on the lower end 24 of the drive shaft 22 and locked in place on the mounting sleeve 30 as described above.

The horizontal or second portions 70 of the slots 62 preferably extend from the first portions 66 in the same direction as the rotational direction of the drive shaft 22 during operation. This insures that the bearing housing 42 is not inadvertently rotated relative to the mounting sleeve 30 to a position where the pins 64 are aligned with the first portions 66 of the slots 62 and the bearing/bearing housing subassembly 52 can fall off the drive shaft 22.

From the foregoing description, one skilled in the art can easily ascertain the essential characteristics of the invention and, without departing from the spirit and scope thereof, make various changes and modifications to adapt it to various usages.

I claim:

1. A bearing assembly for supporting one end of a rotatable shaft having an end portion extending toward and spaced from a support surface, said bearing assembly comprising a mounting sleeve surrounding and spaced radially outwardly from the end portion of the shaft, said mounting sleeve having an inner periphery and opposed first and second edges with said first edge facing the support surface;

support means connected between said mounting sleeve and the support surface for supporting said mounting sleeve at a location where said first edge is spaced away from the support surface a sufficient distance to afford access to the end portion of the shaft through the space between said first edge and the support surface;

an annular bearing slidably mounted on the end of the shaft;

a bearing housing having an outer periphery smaller than the inner periphery of said mounting sleeve, said bearing housing being disposed inside said mounting sleeve and including a bore receiving said bearing to provide a bearing/bearing housing subassembly; and locking means on said bearing housing and said mounting sleeve which cooperate to afford longitudinal movement of said subassembly relative to the shaft and to said mounting sleeve between an unlocked position where said subassembly can be moved longitudinally relative to the shaft into and out of said mounting sleeve and a locked position inside said mounting sleeve where said bearing housing is restrained against longitudinal movement relative to the shaft, the end of the shaft being sufficiently spaced from the support surface so that, when in the unlocked position, said subassembly can be withdrawn from said mounting sleeve and completely off the end of the shaft and moved away from the shaft through the space between said mounting sleeve and the support surface.

2. A bearing assembly according to claim 1 wherein said support means comprises a plurality of circumferentially spaced legs having one end connected to said mounting sleeve and the other end connected to the support surface.

3. A bearing assembly according to claim 1 including limit means on said mounting sleeve for limiting longitudinal movement of said bearing relative to said bearing housing in a direction away from the support surface.

4. A bearing assembly according to claim 3 wherein said bearing has opposed first and second ends with said first end facing away from the support surface; and said limit means comprises a plurality of circumferentially spaced arms having one end connected to said mounting sleeve and extending radially inwardly toward the shaft a sufficient distance to be engaged by said first end of said bearing in the event said bearing moves longitudinally relative to said bearing housing in a direction away from the support surface during rotation of the shaft.

5. A bearing assembly according to claim 1 wherein said locking means comprises a plurality of circumferentially spaced pins extending radially outwardly from the outer periphery of said bearing housing; and a plurality of circumferentially spaced inverted generally J-shaped slots in said mounting sleeve extending from said first edge thereof for receiving said pins.

6. A bearing assembly according to claim 5 wherein the shaft has a rotational axis; and each of said slots includes a first portion extending from said first edge of said mounting sleeve generally parallel to the rotational axis of the shaft, a second portion connected to said first portion and extending generally perpendicular thereto and a third portion connected to said second portion and extending generally perpendicularly thereto in a direction toward the support surface.

7. A bearing assembly according to claim 1 wherein said bearing has inner and outer peripheries and includes a plurality of circumferentially spaced, axially extending grooves in said inner and outer peripheries for affording a flow of a cleaning liquid between said bearing and the shaft and between said bearing and said bearing housing.

8. A bearing assembly supporting one end of a rotatable agitator drive shaft having a lower end disposed in a mixing tank and extending toward and spaced from the bottom of the tank, said bearing assembly comprising a mounting sleeve surrounding and spaced radially outwardly from the lower end of the drive shaft, said mounting sleeve having an inner periphery and opposed first and second edges with said first edge facing the tank bottom;

support means connected between said mounting sleeve and the tank bottom for supporting said mounting sleeve on the tank bottom at a location where said first edge is spaced away from the tank bottom a sufficient distance to afford access to the lower end of the drive shaft through the space between said first edge and the tank bottom;

an annular bearing slidably mounted on the lower end of the drive shaft;

a bearing housing having an outer periphery smaller than the inner periphery of said mounting sleeve, said bearing housing being disposed in said mounting sleeve and including a bore receiving said bearing to provide a bearing/bearing housing subassembly; and locking means on said bearing housing and on said mounting sleeve which cooperate to afford longitudinal movement of said subassembly relative to the drive shaft and to said mounting sleeve between an unlocked position where said subassembly can be moved longitudinally relative to the drive shaft into and out of said mounting sleeve and an unlocked position inside said mounting sleeve where said bearing housing is restrained against longitudinal movement relative to the drive shaft, the lower end of the drive shaft being sufficiently spaced from the tank bottom so that, when in the unlocked position, said subassembly can be withdrawn downwardly from said mounting sleeve and completely off the drive shaft and then moved away from the drive shaft through the space between said mounting sleeve and the tank bottom.

9. A bearing assembly according to claim 8 wherein said locking means comprises a plurality of circumferentially spaced pins extending radially outwardly from the outer periphery of said bearing housing; and a plurality of circumferentially spaced, inverted J-shaped slots in said mounting sleeve extending from said first edge thereof for receiving said pins.

10. A bearing assembly according to claim 9 wherein the drive shaft has a rotational axis; and said slot includes a first portion extending from said first edge of said mounting sleeve and generally parallel to the rotational axis of the drive shaft, a second portion connected to and extending generally perpendicularly to said first portion and a third portion connected to said second portion and extending generally perpendicular thereto in a direction toward the tank bottom.

11. A bearing assembly according to claim 9 wherein said support means comprises a plurality of circumferentially spaced legs having one end connected to said mounting sleeve and the other end connected to the tank bottom.

12. A bearing assembly according to claim 11 including limit means on said mounting sleeve for limiting longitudinal movement of said bearing relative to said bearing housing in a direction away from the tank bottom.

13. A bearing assembly according to claim 12 wherein said bearing housing has opposed upper and lower ends with said upper end facing away from the tank bottom; and said limit means comprising a plurality of circumferentially spaced arms having one end connected to said mounting sleeve and extending radially inwardly toward the drive shaft a sufficient distance to be engaged by said upper end of said bearing in the event said bearing moves longitudinally relative to said bearing housing in a direction away from the tank bottom during rotation of the drive shaft.

14. A bearing assembly according to claim 9 wherein said bearing has inner and outer peripheries and includes a plurality of circumferentially spaced, axially extending grooves in said inner and outer peripheries for affording a flow of a cleaning liquid between said bearing and the drive shaft and between said bearing and said bearing housing.

* * * * *

UNITED STATES PATENT AND TRADEMARK OFFICE
Certificate

Patent No. 5,618,107 Patented: April 8, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Steve A. Bartsch, Marshfield, WI; and Michael E. Beck, Maribel, WI.

Signed and Sealed this Eleventh Day of November 2003.

WANDA L. WALKER
*Supervisory Patent Examiner*
*Art Unit 1723*